US006240262B1

(12) United States Patent
Taniyama et al.

(10) Patent No.: US 6,240,262 B1
(45) Date of Patent: May 29, 2001

(54) TONER SUPPLY DEVICE AND TONER CARTRIDGE

(75) Inventors: Yoshiharu Taniyama, Kawasaki; Tomoyuki Asada; Shinichi Itoh, both of Yokohama, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,607

(22) Filed: Feb. 18, 2000

(51) Int. Cl.[7] ..... G03G 15/00
(52) U.S. Cl. ..... 399/12; 399/262
(58) Field of Search ..... 399/12, 24, 25, 399/27, 258, 262; 222/DIG. 1

(56) References Cited

U.S. PATENT DOCUMENTS 4,963,939 * 10/1990 Kurando et al. ..... 399/12
5,088,144 * 2/1992 Schneider ..... 15/1.51
5,761,566 * 6/1998 Suzuki et al. ..... 399/12
5,983,059 * 11/1999 Oka et al. ..... 399/262
5,999,759 * 12/1999 Palumbo et al. ..... 399/27

FOREIGN PATENT DOCUMENTS 62-173482 * 7/1987 (JP) .
4-001682 * 1/1992 (JP) .
4-062564 * 2/1992 (JP) .
5-224479 * 9/1993 (JP) .
10-20642 1/1998 (JP) .
11-338210 * 10/1999 (JP) .

* cited by examiner

*Primary Examiner*—Robert Beatty
(74) *Attorney, Agent, or Firm*—Foley & Lardner

(57) ABSTRACT

A toner supply device comprises: a toner cartridge, which is used for an image forming system, including a substantially cylindrical container for housing therein a toner and which is supplied when the toner is insufficient for the image forming system; an information recording part which is provided on the peripheral surface of the container and on which information including that the toner is a certified product has been recorded; a rotating unit, connected to the tip portion of the container when the container is attached, for rotating the container along the peripheral surface; a cleaning unit, provided in the vicinity of the container, for contacting the information recording part of the container in response to the operation of the rotating unit during the reading operation of a reading sensor, to sequentially clean the information recording part by the rotation of the container; and a reading sensor, provided in the vicinity of the container and in front of the cleaning unit in rotational directions of the toner cartridge, for sequentially reading the information on the information recording part cleaned by the cleaning unit in response to the operation of the rotating unit.

19 Claims, 6 Drawing Sheets

TONER SUPPLY DEVICE AND TONER CARTRIDGE

BACKGROUND OF THE INVENTION

1. Field of the Invention

The present invention relates generally to a toner supply device and a toner cartridge for use in an image forming apparatus. More specifically, the invention relates to a toner supply device capable of reading information relating to a toner, and a toner cartridge, in which the information has been recorded.

2. Description of the Related Background Art

Toners supplied to image forming systems, such as copying machines, facsimiles and printers, have been improved as important components for enhancing the quality of an image, and manufacturers have provided the optimum toners for the design specification of their systems as genuine products (which will be hereinafter referred to as "certified products").

In recent years, toners meeting the minimum specifications common to image forming systems commercially available from a plurality of manufacturers are in circulation. There is a problem in that such toners meeting only a part of specifications (which will be hereinafter referred to as "uncertified toners") generally have inferior image quality and have a bad influence on a photosensitive material drum serving as an image carrier and a developing part, to damage the reliability of the systems.

A typical toner is housed in a container to be provided. Conventionally, although toners have been sometimes improved to be easily operated, toners have not often been improved to recommend the certified products.

In addition, the shape of toner cartridges has been sometimes changed in accordance with the destination for image forming systems, e.g., in accordance with the market, such as OEM provided manufacturers or countries other than the country of manufacture. This causes to produce various kinds of toner cartridges to prevent the producing costs from being reduced by common parts.

SUMMARY OF THE INVENTION

It is therefore a first object of the present invention to provide a toner supply device which has the function of determining whether a toner cartridge attached thereon is a certified product and which insures high image quality by recommending a user to utilize the certified product when the toner cartridge houses therein an uncertified toner.

It is a second object of the present invention to provide a toner cartridge, in which information including that the toner cartridge houses therein a certified toner has been recorded.

According to the first aspect of the present invention, there is provided; a toner supply device comprising: a toner cartridge, which is used for an image forming system, including a container for housing therein a toner which is supplied when the toner is insufficient for the image forming system; an information recording part which is provided on the external surface of the container and on which information relating to the toner has been recorded; and a reading sensor for reading the information when the toner cartridge is attached on the image forming system.

Since the reading sensor reads information relating to the toner recorded in the information recording part, it is possible to determine whether a newly attached container is a certified product, in accordance with the presence of the information and/or the contents of the read information.

In a preferred embodiment of the invention, the container has a substantially cylindrical shape, and the information relating to the toner has been recorded on the peripheral surface of the container, and the toner supply device further comprises a rotating unit, connected to the tip portion of the toner cartridge when the toner cartridge is attached, for rotating the container along the peripheral surface, and the reading sensor sequentially reads the information in response to the rotation of the container.

With this construction, when the toner cartridge is attached, the container is rotated in a first direction by the rotating unit, and the information is read by the reading sensor, so that it is possible to easily determine whether a container is the certified product. When it is determined that the container is a certified product, the rotating unit rotates the container in a second rotational direction opposite to the first rotational direction to supply the toner to the image forming system while agitating the toner.

In a further preferred embodiment of the invention, the toner supply device further comprises a cleaning unit, provided on the rotational upstream side of the reading sensor and in the vicinity of the container, for contacting the information recording part in response to the operation of the rotating unit when the reading sensor reads the information and for sequentially cleaning the information recording part before the reading operation of the reading sensor by the rotation of the container. Since the cleaning unit previously cleans the information recording part, the reading sensor can exactly read the information.

The rotational upstream side means a rear side in the first rotational direction.

Furthermore, according to the second aspect of the invention, there is provided; a toner cartridge for use in an image forming system, the toner cartridge comprising: a cylindrical container for housing therein a toner to be supplied when the toner is insufficient for the image forming system; and an information recording part, which is provided on the peripheral surface of the container and on which information relating to the toner is recorded, the information being read by a reading sensor when the toner cartridge is attached on the image forming system.

DESCRIPTION OF THE PREFERRED EMBODIMENTS

Referring now to the accompanying drawings, some preferred embodiments of the present invention will be described below.

First, referring to FIG. 1, the schematic construction of an example of an image forming system, to which the present invention is applied, will be described below.

Figure 1:
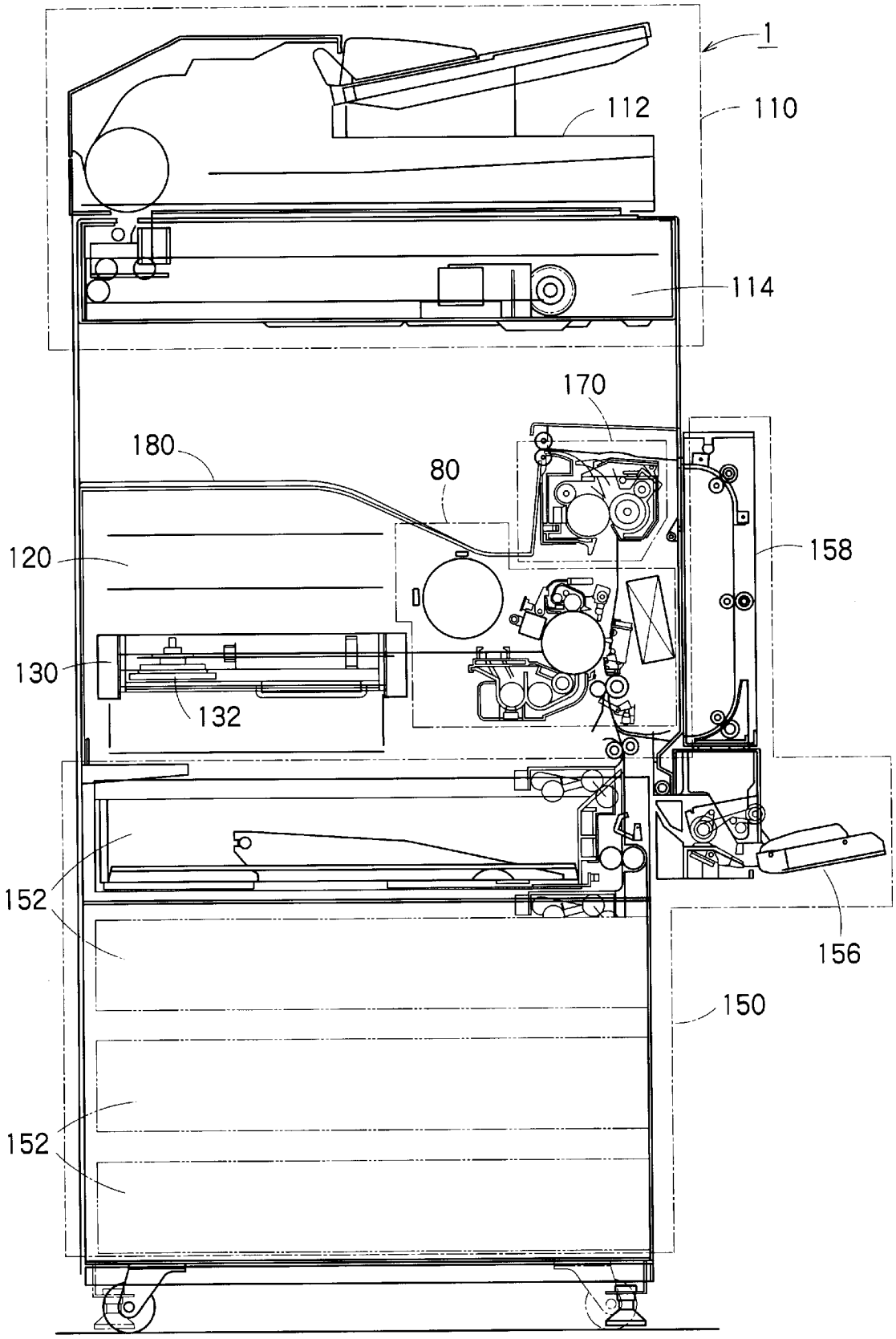
FIG. 1 is a schematic diagram showing an example of a copying machine with a toner supply device according to the present invention.

FIG. 1 is a schematic diagram of an example of a copying machine with a toner supply device in this preferred embodiment, which is viewed from the front. A copying machine 1 shown in this figure is a plain paper copier of a digital system for once converting image information, which is acquired by optical means, into image data to produce laser beams on the basis of the image data to expose and scan a photosensitive material drum.

As shown in FIG. 1, the copying machine 1 comprises an image reading part 110 provided in the upper portion of the machine body thereof, an image storing part 120 provided in the middle portion of the machine body, a laser unit 130, an image forming part 80, a fixing part 170 and a paper feeding part 150.

The paper feeding part 150 includes a plurality of stages of paper feeding units 152*a* and 152*d*, a manual paper feeding tray 156 and a double face unit 158. The paper feeding units 152*a* through 152*d* are provided in the bottom portion of the machine body, and house therein a large number of sheets, on which images are transferred. Although plain papers are usually used as the sheets, tracing papers and OHP films may be used. The manual paper feeding tray 156 is provided in the vicinity of the image forming part 150 on the right side of the machine body, so that sheets having sizes other than the Japanese Industrial Standard sizes, and cardboards such as postal cards can be manually fed. The double face unit 158 is provided on the right side in the middle portion of the machine body, and turns a sheet, which has once passed through the image forming part 80 and to one face of which an image has been transferred, over to feed the sheet to the image forming part 80 again to copy images on both sides of the sheet.

The image reading part 110 includes a scanner 114 and an automatic document feeding unit 112. The scanner 114 reads the image of a manuscript and converts the image into image data. The automatic document feeding unit 112 feeds a sheet manuscript into the scanner 114.

The image storing part 120 stores therein image data supplied from the scanner 114. The laser unit 130 has a plurality of semiconductor laser oscillators (not shown) and a polygon mirror 132. The image data are taken out from the image storing part 120, and the semiconductor laser oscillators are caused to emit laser beams LB, which are reflected on the polygon mirror 132 to scan on the image forming part 160.

Figure 2:
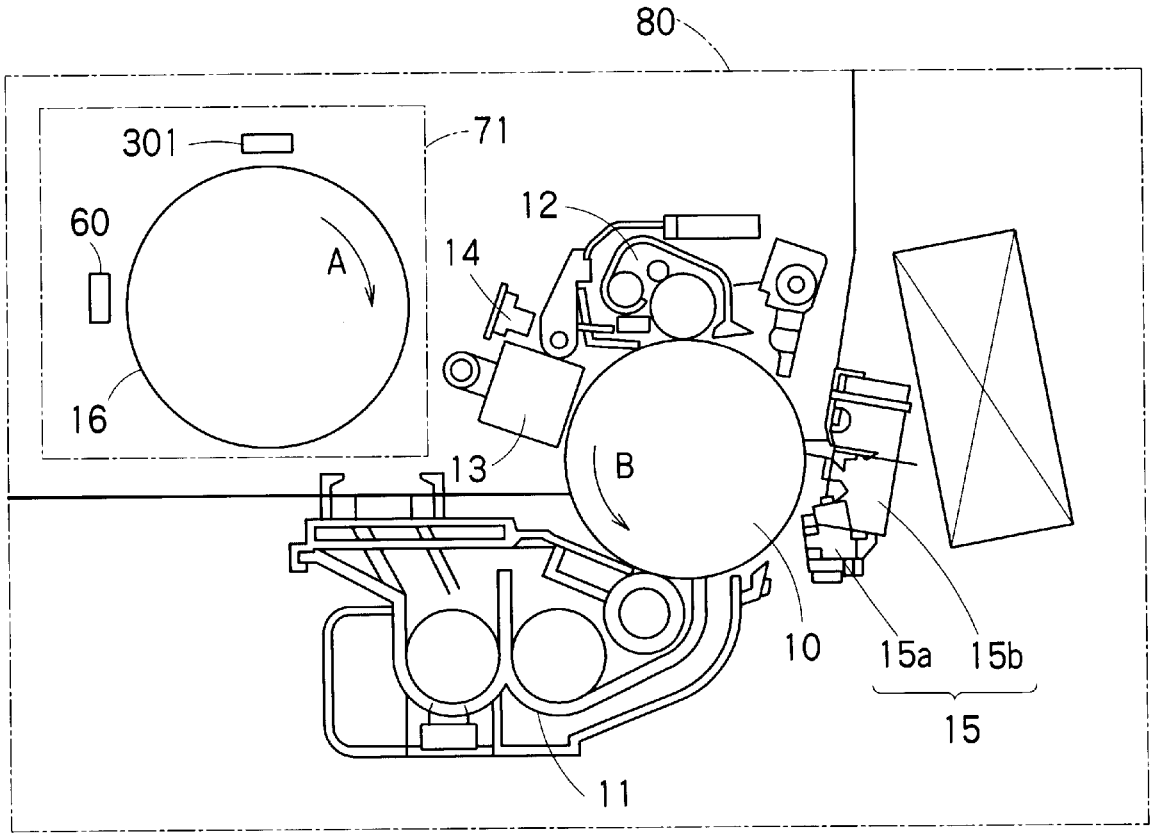
FIG. 2 is an enlarged view of an image forming part of the copying machine of FIG. 1.

FIG. 2 is an enlarged front view showing a principal part of the image forming part 80. As shown in this figure, the image forming part 80 comprises a photosensitive material drum 10, an electrification charger 13, a developing device 11, a transfer/peeling charger 15, a drum cleaner 12, a de-electrifying lamp 14, and a toner supply device 71 in this preferred embodiment.

During a developing operation, the photosensitive material drum 10 rotates counterclockwise B.

The image forming part 80 shown in FIG. 2 adopts a reverse developing system. In the image forming part 80, when the electrification charger 13 electrifies electric charges of a negative polarity on the photosensitive material drum 10 and when the photosensitive material drum 10 is exposed to the laser beams LB emitted from the laser unit 130, the surface potential of the photosensitive drum 10 in a region corresponding to the image portion of the manuscript approaches zero in accordance with the density of the image to form a latent image.

The copying machine 1 adopts a two-component system. The developing device 11 houses therein a carrier and a toner. The toner is supplied to the developing device 11 so as to have a percentage of about 5% to the carrier of about 95%. The amount of the toner is always monitored by a magnetic sensor (not shown) or the like. If the percentage of the toner in the developing device 11 falls below 5%, a toner supply part 18, which will be described later, of the toner supply device operates to supply a required amount of toner to the developing device 11. The carrier and the toner are agitated in the developing device 11, so that the electric charges of a negative polarity are applied to the toner by the frictional electrification during agitation. When the latent image arrives above the developing device 11 by the rotation of the photosensitive material drum 10, the toner is absorbed onto the photosensitive material drum 10 via the carrier to form a visible image. The visible image is carried from the paper feeding part 150 to be transferred to a sheet which is previously electrified to a positive polarity by a transfer charger 15*a*. Immediately after the transfer, positive charges are removed from the sheet by a peeling charger 15*b*, to which the image has been transferred, and then, the sheet is carried to the fixing part 170. The fixing part 170 causes the toner to fuse and adhere to the sheet by the thermo compression bonding, and carries the sheet to a paper discharging tray 180 (see FIG. 1).

The toner which has not been transferred to the sheet and which remains on the surface of the photosensitive material drum 10, together with paper powder adhering to the toner from the sheet, is removed by the drum cleaner 12. The remaining charges of the photosensitive material drum 10 are removed by the de-electrifying lamp 14.

In this preferred embodiment, the toner supply device 71 comprises a substantially cylindrical toner cartridge 16, an optical sensor 60 and a cleaning part301. As will be described later, when the toner cartridge 16 is driven and rotated clockwise A (a second rotational direction) by a rotating unit 19, the toner cartridge 16 discharges a toner via a toner supply hole 17, which is provided in the tip portion (the inside portion viewed from the front of the machine body), to supply the toner into the developing device 11.

Figure 3:
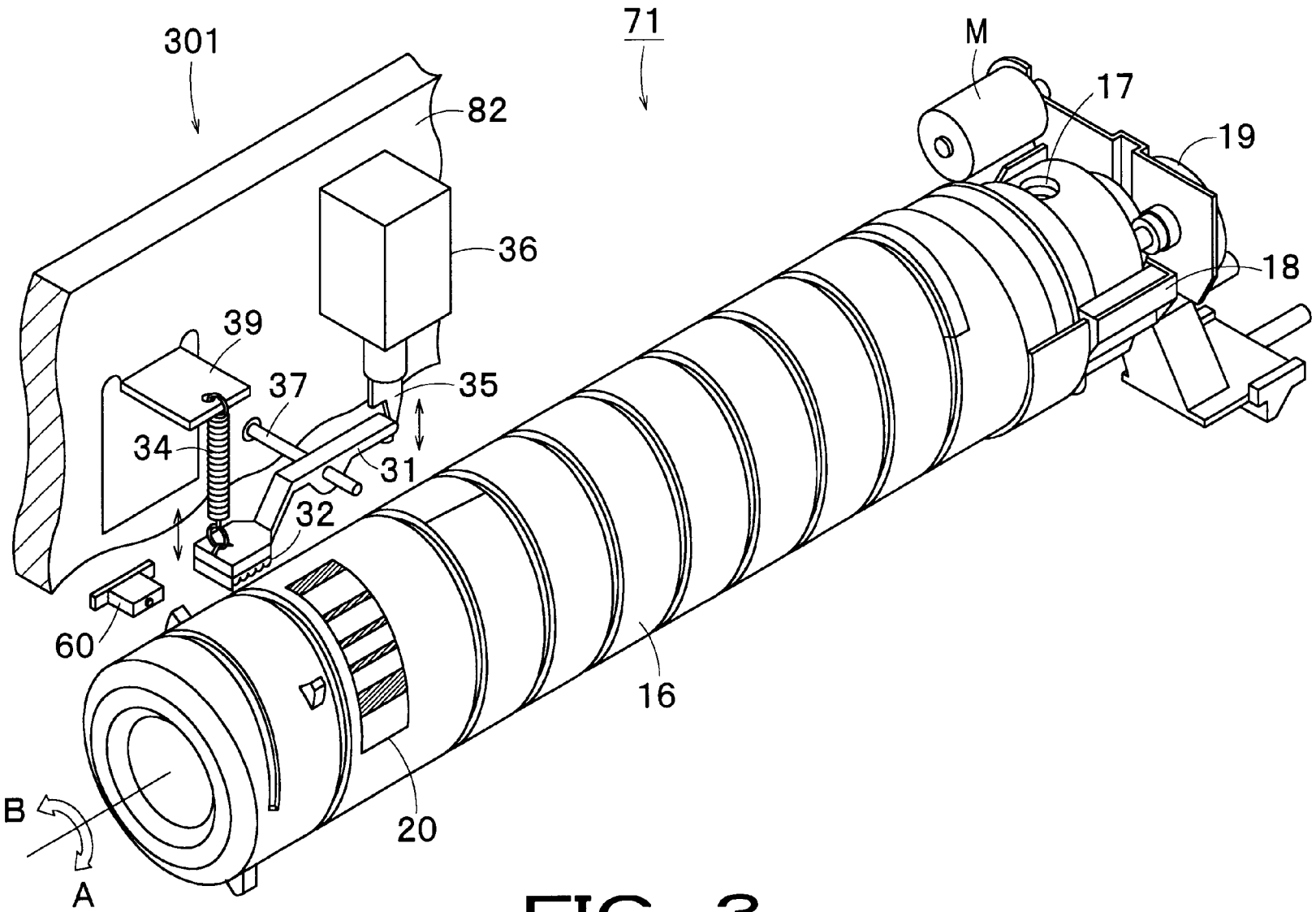
FIG. 3 is a schematic perspective view of the first preferred embodiment of a toner supply device according to the present invention.

Referring to FIG. 3, the detailed construction of the toner supply device 71 in this preferred embodiment will be described below. Furthermore, in each of figures which will be shown later, the same reference numbers will be used for the same parts as those in FIG. 3, and the descriptions thereof will be suitably omitted.

FIG. 3 is a schematic perspective view of the toner supply device 71 in this preferred embodiment. This figure shows the state that the toner cartridge 16 is inserted into the toner supply device 71 along a guide (not shown) to be mounted therein. As described above, the toner cartridge 16 has a substantially cylindrical shape, and has the toner supply hole 17 in the peripheral surface of the tip portion thereof. When the toner cartridge 16 is attached, the tip portion thereof is pressed to be connected to the toner supply part 18.

The toner supply part 18 is connected to the rotating unit 19 including a drive motor M. The rotating unit 19 receives a command from a control part (not shown) to rotate the toner cartridge 16 counterclockwise B (a first rotational direction) or clockwise A although the detailed construction of the rotating unit 19 is omitted. By this rotation operation, the toner housed in the toner cartridge 16 is agitated.

The toner cartridge 16 has a spiral protruding portion (not shown) on the inner peripheral surface thereof. By such an internal shape, if the toner cartridge 16 is rotated clockwise A by the rotating unit 19 via the toner supply part 18, the toner moves toward the toner supply hole 17 formed at the tip portion while being agitated.

On the peripheral surface of the cylinder rear end portion (the front side portion viewed from the front of the machine body) of the toner cartridge 16, a discriminating label 20 serving as the feature of this preferred embodiment is applied. The discriminating label 20 has a width of 10 to 20 mm, and is applied so as to extend in rotational directions of the toner cartridge 16. On the discriminating label 20, information relating to the toner cartridge 16 is recorded. In this preferred embodiment, the information is recorded in the form of a bar code. The contents of the information include the fact that the toner cartridge 16 is a certified product, the type and destination (countries and regions on the market, and OEM provided manufacturers) of machines, on which the toner cartridge 16 is attached, the capacity of the container, the material and components of the toner, and so forth. The contents of the information also include information relating to the color of the toner when the toner cartridge 16 is used for a color copying machine or a color printer. The surface of the discriminating label 20 is covered with a translucent material to prevent flying toner and dust from adhering thereto.

The optical sensor 60 is provided at a position corresponding to a region, on which the discriminating label 20 is applied in the vicinity of the toner cartridge 16, and sequentially reads the information recorded on the discriminating label 20 when the toner cartridge 16 rotates counterclockwise B.

The cleaning part 301 includes a cleaning member 32, a lever 31, a spring 34, an anchoring member 39, a hook 35 and a solenoid 36. The cleaning member 32 is provided on the bottom surface of the tip portion (the front side portion viewed from the front of the machine body) of the lever 31. A pivot hole is formed in the lever 31 slightly inside of the central portion thereof. A shaft 37 extending from a supporting plate 82 passes through the pivot hole, and the lever 31 is pivotably supported on the shaft 37 so as to be oscillatable about the pivot hole. The tip portion of the lever 31 is connected to one end of the spring 34, the other end of which is connected to the tip portion of the anchoring member 39 projecting from the supporting plate 82. By the spring 34, the tip portion of the lever 31 is fixed so that the cleaning member 32 is spaced from the toner cartridge 16 by a predetermined distance in a usual state. The size of the protruding portion of the anchoring member 39 is adjusted so that the tip portion of the lever 31 is positioned on the rotational upstream side of the optical sensor 60, i.e., on the rear side in the rotational direction of the toner cartridge 16, so that the peripheral surface previously cleaned by the cleaning member 32 reaches the detection range of the optical sensor 60 when the toner cartridge 16 rotates counterclockwise.

The rear end portion (the inside portion viewed from the front of the machine body) of the lever 31 engages the tip portion of the hook 35. The rear end of the hook 35 is connected to the solenoid 36. Thus, the rear end portion of the lever 31 moves vertically in accordance with the ON/OFF of the solenoid 36 via the hook 35.

The functions of the optical sensor 60 and the cleaning part 301 will be described below.

While the copying machine 1 is used, if all of the toner in the toner cartridge 16 is supplied and if the amount of the toner in the developing device 11 falls below a standard value (5% in this preferred embodiment), an indication "toner empty" appears on a control panel (an operating panel) (not shown) of the copying machine 1 to urge the user to exchange the toner cartridge 16. The user who looked at this indication prepares a new toner cartridge 16 to carry out an exchange operation.

First, the user opens a front cover (not shown) which is provided on the front of the image forming part 80 and which is capable of being open and closed, and detaches the empty toner cartridge 16.

Then, the user attaches the new toner cartridge 16 on the toner supply device 71, and closes the front cover.

When the new toner cartridge 16 is attached, the copying machine 1 determines whether the attached toner cartridge 16 is a certified product before a toner supply operation is carried out.

Specifically, the toner cartridge 16 is rotated by the rotating unit 19 of the toner supply 18 counterclockwise B, e.g., in the opposite direction to the rotational direction A during supply, by two revolutions or more. Thus, the optical sensor 60 reads information recorded on the discriminating label 20. At this time, if the discriminating label 20 is not applied on the toner cartridge 16 or if information different from a desired specification is recorded on the discriminating label 20 even if the discriminating label 20 is applied on the toner cartridge 16, the copying machine 1 determines that the attached toner cartridge 16 is an uncertified product, so that the copying machine 1 is stopped. The determined result indicative of the uncertified product may be displayed on the control panel so as to be given to the user, or may be derived only by a field engineer by inputting a predetermined service code. In addition, if the operating condition of the copying machine can be remote-controlled using a communication line or the like, information relating to the determined result may be transmitted to a control computer of a service center to be communicated to a field engineer, an agent in charge of the user, or a salesman.

The cleaning part 301 cleans the surface of the discriminating label before the reading operation of the optical sensor 60. That is, while the rotating unit 19 starts to rotate the toner cartridge 16 counterclockwise B, the solenoid 36 is turned ON to move the hook 35 upwards. In accordance with the movement of the hook 35, the lever 31 oscillates about the pivot hole, and the spring 34 is extended, so that the cleaning member 32 of the tip portion of the lever 31 contacts the peripheral surface of the toner cartridge 16 to clean the translucent material overlaying the discriminating label 20 to remove dust, such as toner and paper powder, which adheres to the surface thereof.

When the optical sensor 60 reads the fact that the information recorded on the discriminating label 20 is coincident with the condition of the specification, the copying machine 1 determines that the attached toner cartridge 16 is a certified product, and ends the above described discriminating operation.

When the discriminating operation of the copying machine 1 ends, the solenoid 36 is turned OFF, so that the cleaning member 32 is separated from the toner cartridge 16. The solenoid 36 remains being OFF during the supply of the toner.

Then, the toner supply device 71 carries out an operation of agitating the toner in the toner cartridge 16 before the toner is supplied to the developing device 11. That is, the rotating unit 19 rotates the toner cartridge 16 on a position, at which the discriminating label 20 is applied, alternately clockwise A and counterclockwise B by predetermined angles, respectively.

Since such an oscillating operation can break lumps of the toner if the toner has gathered in the toner cartridge 16 in a preservative period and/or in a state of preservation, the amount of the toner subsequently supplied can be stabilized. Thus, it is not required to carry out the agitating operation for the toner cartridge 16, which has been conventionally carried out by the user before attaching the toner cartridge 16, so that it is possible to relieve the user's work load.

Referring to the accompanying drawings, the second preferred embodiment of a toner supply device according to the present invention will be described below.

Figure 4:
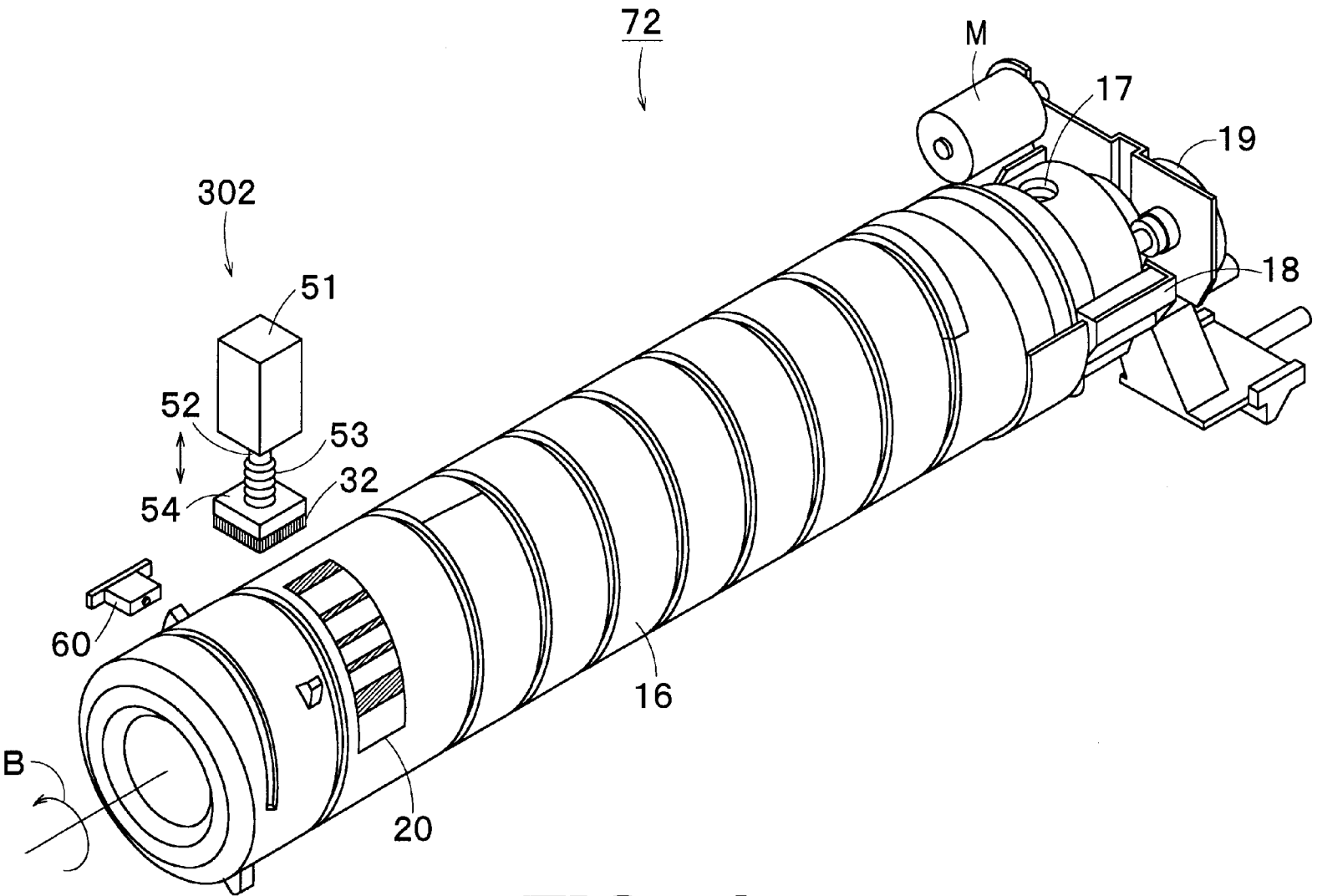
FIG. 4 is a schematic perspective view of the second preferred embodiment of a toner supply device according to the present invention.

FIG. 4 is a perspective view showing the schematic construction of a toner supply device in this preferred embodiment. A toner supply device 72 in this preferred embodiment can also be attached on the copying machine 1 shown in FIG. 1.

As can be clearly seen from the comparison with FIG. 3, this preferred embodiment is characterized by the construction of a cleaning part 302. Other constructions are the same as those of the above described toner supply device 71.

The cleaning part 302 includes a solenoid 51 having a vertically movable shaft 52, a pad 54 secured to the tip of the shaft 52, a cleaning member 33 provided on the bottom surface of the pad 54, and a pressing spring 53 wound onto the shaft 52. The pressing spring 53 is a tension spring, one end of which engages the bottom surface of the solenoid 51, and the other end of which engages the top surface of the pad 54. The solenoid 51 is mounted at a position, at which the cleaning member 32 is spaced from the toner cartridge in the OFF state, above a region, in which the discriminating label 20 is provided on the peripheral surface of the toner cartridge 16. Furthermore, the supporting plate 82 and the connection of the supporting plate 82 to the cleaning part 302 are omitted from FIG. 4.

The operation of the toner supply device 72 in this preferred embodiment is as follows.

A new toner cartridge 16 is attached, and the copying machine 1 starts an operation of discriminating the toner cartridge. First, the rotating unit 19 of the toner supply part 18 operates to rotate the toner cartridge 16 counterclockwise B. When the rotating unit 19 operates, the solenoid 51 is turned ON in response thereto. Thus, the pad moves downwards, and the cleaning member 32 sequentially cleans the translucent material overlaying the discriminating label 20. If the cleaned surface of the discriminating label 20 reaches the detection range of the optical sensor 60, the optical sensor 60 sequentially reads information recorded on the discriminating label. Thus, information relating to the toner cartridge 16 is read to determine whether the attached toner cartridge 16 is a certified product. The operations of the copying machine 1 after the discrimination are the same as those in the above described first preferred embodiment.

If the discriminating operation of the copying machine 1 ends, the solenoid 51 is turned OFF to allow the pad 54 to be pulled by the pressing spring 53 toward the solenoid 51, so that the cleaning member 33 is separated from the toner cartridge 16.

Subsequent toner agitating and toner supply operations are the same as those in the above described first preferred embodiment.

Referring to the accompanying drawings, the third preferred embodiment of a toner supply device according to the present invention will be described below.

Figure 5:
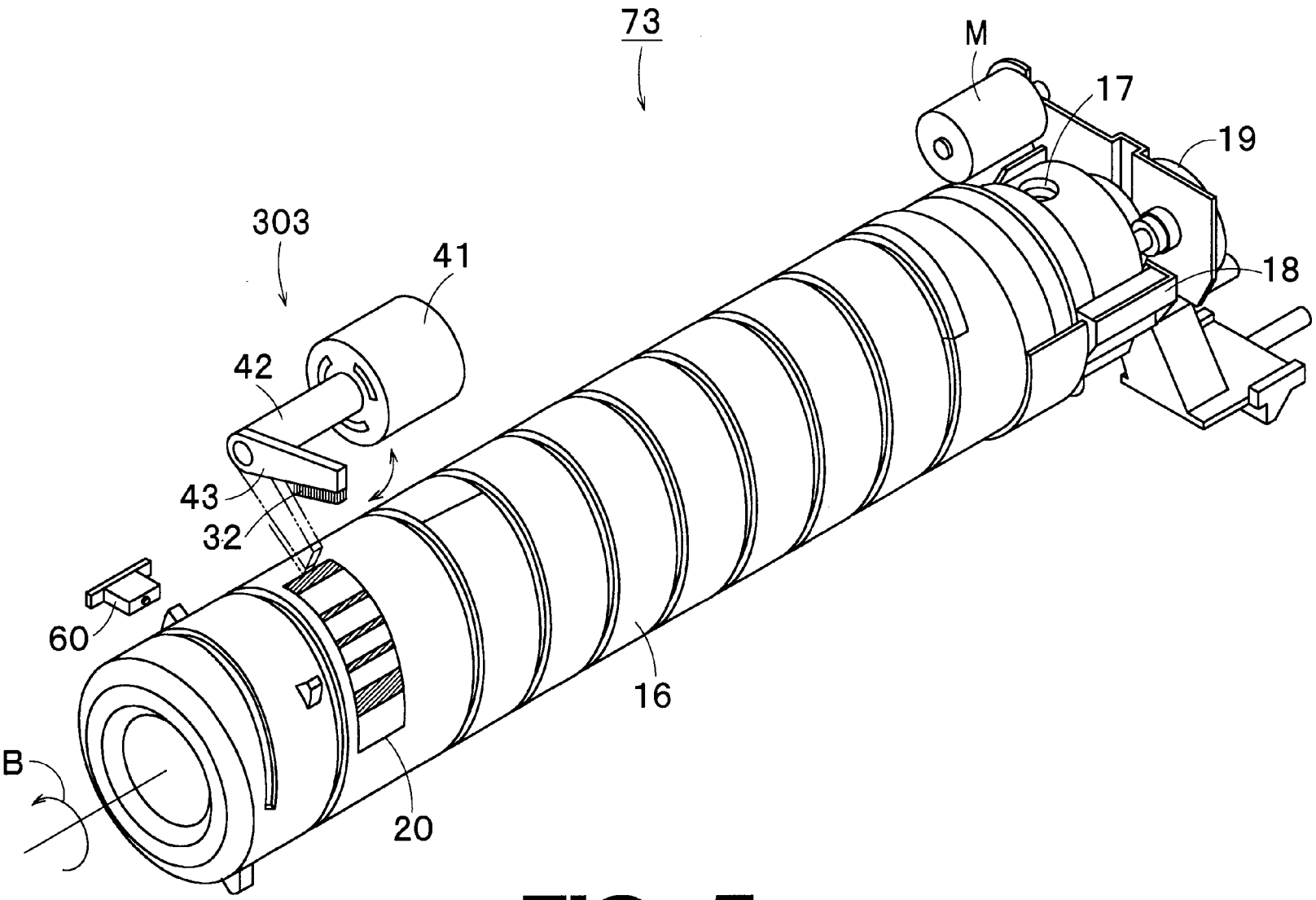
FIG. 5 is a schematic perspective view of the third preferred embodiment of a toner supply device according to the present invention.

FIG. 5 is a perspective view schematically showing a toner supply device in this preferred embodiment. A toner supply device 73 in this preferred embodiment can also be attached on the copying machine 1 shown in FIG. 1.

As can be clearly seen from the comparison with FIG. 3, this preferred embodiment is characterized by the construction of a cleaning part 303. Other constructions are the same as those of the above described toner supply device 71. Furthermore, the supporting plate 82 and the connection of the supporting plate 82 to the cleaning part 303 are also omitted from FIG. 5.

The cleaning part 303 includes a rotary solenoid 41 connected to one end of a shaft 42 for rotating the shaft 42, an arm 43 connected to the other end of the shaft 42 so as to be substantially perpendicular to the shaft 42, and a cleaning member 32 pivoted on the bottom surface of the tip portion of the arm 43.

The operation of the toner supply device 73 in this preferred embodiment is as follows.

When a new toner cartridge 16 is attached and when the copying machine 1 starts an operation of discriminating the toner cartridge, the rotating unit 19 of the toner supply part 18 operates to rotate the toner cartridge 16 counterclockwise B. In response to the operation of the rotating unit 19, the rotary solenoid 41 is turned ON to rotate the arm 43 clockwise by a predetermined angle via the shaft 42, and then the rotary solenoid 41 is turned OFF. Thus, the cleaning member 33 contacts the discriminating label 20 by the rotation of the toner cartridge 16. Thus, the translucent material overlaying the discriminating label 20 is sequentially cleaned. If the cleaned surface of the discriminating label 20 reaches the detection range of the optical sensor 60, the optical sensor 60 sequentially reads information recorded on the discriminating label. Thus, information relating to the toner cartridge 16 is read to determine whether the attached toner cartridge 16 is a certified product. The operations of the copying machine 1 after the discrimination are the same as those in the above described first preferred embodiment.

If the discriminating operation of the copying machine 1 ends, the rotary solenoid 41 is turned on again in response to the stopped operation of the rotating unit 19, and then, the rotary solenoid 41 rotates the arm 43 counterclockwise by a predetermined angle via the shaft 42 to be turned OFF. Thus, the cleaning member 32 is separated from the toner cartridge 16.

Subsequent toner agitating and toner supply operations are the same as those in the above described first preferred embodiment.

Referring to the accompanying drawings, the fourth preferred embodiment of a toner supply device according to the present invention will be described below.

Figure 6:
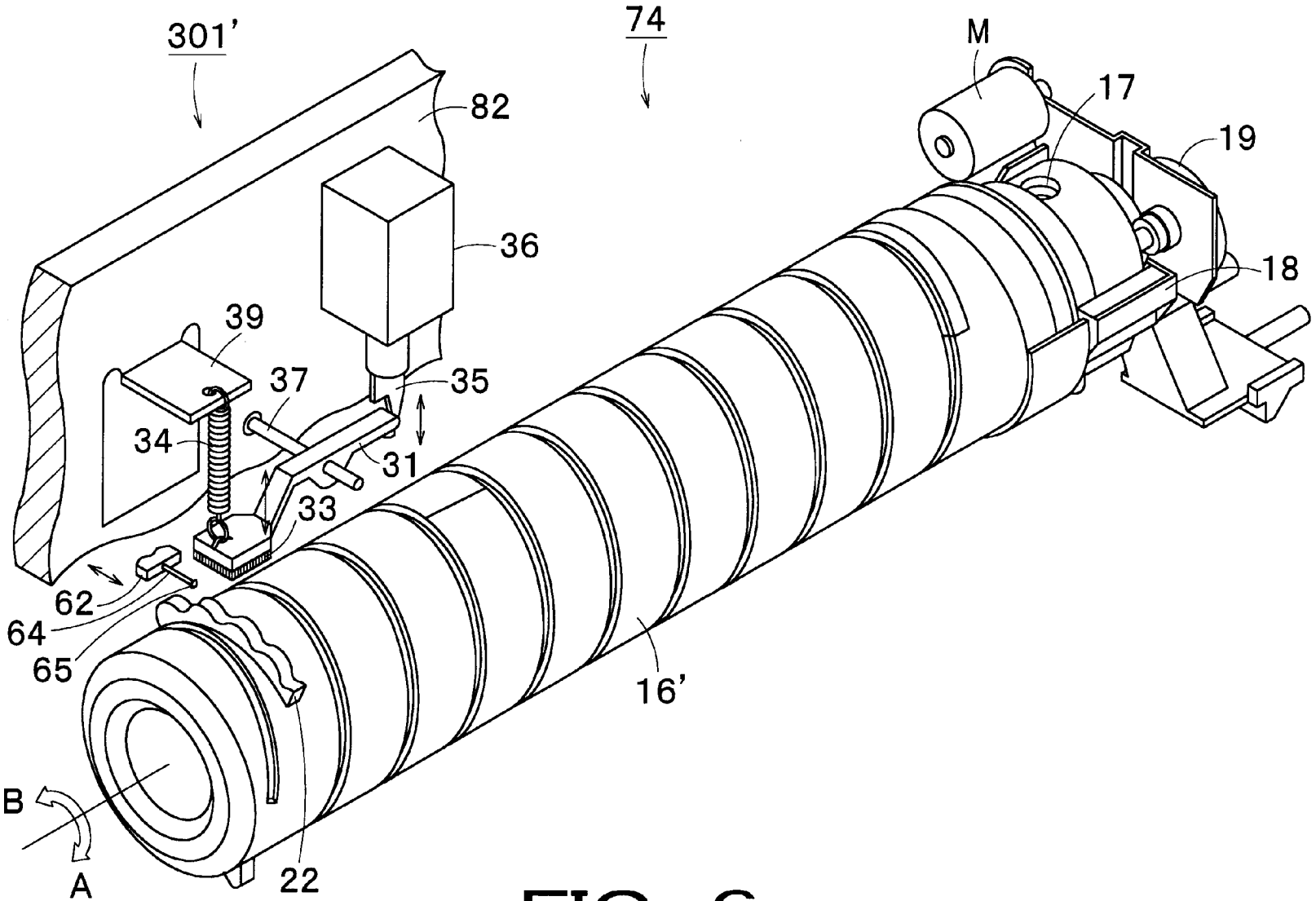
FIG. 6 is a schematic perspective view of the fourth preferred embodiment of a toner supply device according to the present invention.

FIG. 6 is a perspective view schematically showing a toner supply device in this preferred embodiment. A toner supply device 74 in this preferred embodiment can also be attached on the copying machine 1 shown in FIG. 1.

As can be clearly seen from the comparison with FIG. 3, this preferred embodiment is characterized by an arcuate protruding portion 22 substituted for the discriminating label 20, a cleaning member 33 of a brush, and a pressure sensor 62 substituted for the optical sensor 60. Other constructions are substantially the same as those of the toner supply device 71 shown in FIG. 3.

The arcuate protruding portion 22 is provided on the peripheral surface of the rear end of a toner cartridge 16' so as to be arcuate parallel to the rotational direction of the toner cartridge 16'. A plurality of recessed portions extending a direction substantially perpendicular to the rotational direction of the toner cartridge 16' are formed in the surface of the arcuate protruding portion 22. Information relating to the toner cartridge 16' is recorded on the arcuate protruding portion 22 in the form of the intervals and number of the recessed portions.

The positions of the anchoring member 39 and the solenoid 36 are adjusted so that the cleaning member 33 is positioned above the arcuate protruding portion 22.

The pressure sensor 62 is provided on the supporting plate 82 via a moving mechanism (not shown). The pressure sensor 62 includes a contact 64 having a semi-spherical contact surface 65 provided at the tip thereof, and a pressure sensing part (not shown) for sensing the movement of the contact 64. The contact 64 is provided so as to be capable of vibrating in longitudinal directions, and the pressure sensing part senses the longitudinal vibration.

The operation of the toner supply device 74 in this preferred embodiment will be described below. The different points from the above described first preferred embodiment will be mainly described below.

When a new toner cartridge 16' is attached, the solenoid 36 is first turned on from the OFF state to oscillate the lever 31 via the hook 35, so that the cleaning member 33 moves to a position, at which the cleaning member 33 contacts the surface of the arcuate protruding portion 22. Simultaneously, the moving mechanism (not shown) of the pressure sensor 62 operates to move the pressure sensor 62 to a position, at which the contact surface 65 of the contact 64 reaches the arcuate protruding portion 22.

Then, the rotating unit 19 of the toner supply part 18 operates to rotate the toner cartridge 16' counterclockwise B. Thus, the surface of the arcuate protruding portion 22 is sequentially cleaned by the brush of the cleaning member 33. When the cleaned surface of the arcuate protruding portion 22 reaches the position of the pressure sensor 62, the contact surface 65 of the contact 64 contacts the surface of the arcuate protruding portion 22 to vibrate in longitudinal directions in accordance with the presence of the recessed portions. This vibration is detected by the sensing part of the pressure sensor 62 to read information relating to the toner cartridge 16' to determine whether the attached toner cartridge 16' is a certified product. The operations of the copying machine 1 after the discrimination are the same as those in the above described first preferred embodiment.

If the discriminating operation of the copying machine 1 ends, the solenoid 36 is turned OFF, so that the cleaning member 33 is separated from the toner cartridge 16'. Simultaneously, the pressure sensor 62 is also separated from the toner cartridge 16' by the moving mechanism (not shown).

Subsequent toner agitating and toner supply operations are the same as those in the above described first preferred embodiment.

While the preferred embodiments of the present invention have been described above, the present invention should not be limited thereto, but the invention can be embodied in various ways without departing fromthe principle of the invention.

While the optical sensor or the pressure sensor has been used as the sensor for reading information relating to the toner cartridge in the above described preferred embodiment, the present invention should not be limited thereto. For example, a discriminating label, on which the above described information has been recorded in the form of magnetism, may be applied on the peripheral surface of the toner cartridge, and this information may be read by a magnetic sensor. In this case, it is not required to provide any cleaning members.

In addition, while the rotating unit has rotated the container to agitate the toner while supplying the toner to the developing device in the above described preferred embodiments, a conventional toner supply device having no rotating unit may read information relating to a container, which is recorded on the container itself, by moving a reading sensor. In addition, the information recorded on the container should not be limited to information in the form of a bar code, magnetism or concavoconvex shape, it may be optical pattern information, which can be optically recognized, such as hologram information, or shape pattern information which can be recognized by contact.

Moreover, while the toner supply device has been used for the copying machine of the digital system in the above described preferred embodiment, the present invention should not be limited thereto, but it may be used for a conventional analog copying machine, facsimile or laser printer. The copying machine may be a system of monochrome, such as black, or a color system using a plurality of color toners. In the digital copying machine, data supplied from a computer, such as a personal computer or a mini computer, via an interface, such as a SCSI, may be acquired as image signals selectively or in place of the image reading part.

What is claimed is:

1. A toner supply device comprising:

a toner cartridge, which is used for an image forming system, including a container for housing therein a toner which is supplied when the toner is insufficient for the image forming system;

an information recording part which is provided on the external surface of said container and on which information relating to said toner has been recorded;

a reading sensor for reading said information when said toner cartridge is attached on said image forming system, wherein said reading sensor moves along the external surface of said container to sequentially read said information; and a cleaning unit, provided in front of said reading sensor in a moving direction thereof, for moving in response to the movement of said reading sensor, said cleaning unit contacting and cleaning said information recording part of said container before the reading operation of said reading sensor.

2. A toner supply device as set forth in claim 1, wherein said information is recorded on said information recording part in any one of forms of optical pattern information capable of being optically recognized, shape information capable of recognized by contact, and magnetic information.

3. A toner supply device as set forth in claim 2, wherein said information includes information indicating that said toner is a certified product.

4. A toner supply device as set forth in claim 3, wherein said information includes information indicating that said toner is a certified product suitable for the specification of the destination for said image forming system.

5. A toner supply device comprising:

a toner cartridge, which is used for an image forming system, including a container for housing therein a toner which is supplied when the toner is insufficient for the image forming system;

an information recording part which is provided on the external surface of said container and on which information relating to said toner has been recorded, wherein said container has a substantially cylindrical shape, and said information recording part is provided on the peripheral surface of said container;

a reading sensor for reading said information when said toner cartridge is attached on said image forming system;

a rotating unit, connected to the tip portion of said toner cartridge when said toner cartridge is attached, for rotating said container along said peripheral surface, and wherein said container is rotated by said rotating unit to discharge said toner while agitating said toner, and said reading sensor is provided in the vicinity of said container for sequentially reading said information in response to the rotation of said container a cleaning unit, provided in the vicinity of said container, for contacting said information recording part in response to the operation of said rotating unit when said reading sensor reads said information and for sequentially cleaning said information recording part by the rotation of said container.

6. A toner supply device as set forth in claim 5, wherein said rotating unit rotates said container in a first rotational direction when said toner cartridge is attached, and rotates said container in a second rotational direction opposite to said first rotational direction when said toner is supplied, and said cleaning unit is provided upstream of said reading unit in said first rotational direction, and contacts said information recording part when said container rotates in said first rotational direction, said cleaning unit cleaning said information recording part before the reading operation of said reading sensor, said cleaning unit being separated from said information recording part when the reading operation of said reading sensor ends.

7. A toner supply device as set forth in claim 6, wherein said information includes information indicating that said container is a certified product.

8. A toner supply device as set forth in claim 7, wherein said information includes information indicating that said toner is a certified product suitable for the specification of the destination for said image forming system.

9. A toner supply device as set forth in claim 6, wherein said cleaning unit includes a lever provided so as to be oscillatable, a cleaning member provided on the bottom surface of one end of said lever, an actuator connected to the other end of said lever, and an elastic member for anchoring said one end of said lever, and said actuator operates during the reading operation of said reading sensor, to pull said one end of said lever down, to effect said elastic member to extend to cause said cleaning member to contact said information recording part, and stops when the reading operation of said reading sensor ends, to allow said elastic member to pull said other end of said lever to cause said cleaning member to be separated from said information recording part.

10. A toner supply device as set forth in claim 6, wherein said cleaning unit includes an actuator having a rotation shaft, and an arm, one end of which is secured to said rotation shaft and the other end of which is provided with a cleaning member on the bottom surface thereof, and said actuator operates during the reading operation of said reading sensor, to rotate said arm on said rotation shaft to cause said cleaning member to contact said recording part to stop, and operates when the reading operation of said reading sensor ends, to rotate said arm to cause said cleaning member to be separated from said recording part to stop.

11. A toner supply device as set forth in claim 6, wherein said cleaning unit includes an actuator provided in a radial direction of a region, in which said information recording part is provided on the peripheral surface of said toner cartridge, and a sliding shaft, one end of which is connected to said actuator and the tip of the other end of which is provided with a cleaning member, and said actuator operates during the reading operation of said reading sensor, to extend said sliding shaft to cause said cleaning member to contact said recording part, and retracts said sliding shaft when the reading operation of said reading sensor ends, to cause said cleaning member to be separated from said recording part to stop.

12. A toner supply device as set forth in claim 9, wherein said information is recorded on said information recording part in a form of optical pattern information capable of being optically recognized, and said reading sensor is an optical sensor.

13. A toner supply device as set forth in claim 6, wherein said container further has an arcuate protruding portion serving as said information recording part, said arcuate protruding portion protruding from said peripheral surface in rotational directions so as to be arcuate, said information is recorded in a form of concavoconvex shape formed on the surface of said arcuate protruding portion, and said reading sensor is a pressure sensor having a reciprocatable contact, and approaches said container in response to the rotation of said container in said first rotational direction by said rotating unit, to allow said contact to contact the surface of said arcuate protruding portion to detect the reciprocation of said contact to read said information.

14. A toner supply device as set forth in claim 5, wherein said information is recorded on said information recording part in a form of magnetic information, and said reading sensor is a magnetic sensor.

15. A toner cartridge for use in an image forming system, said toner cartridge comprising:

a cylindrical container for housing therein a toner to be supplied when the toner is insufficient for said image forming system; and an information recording part, which is provided on the peripheral surface of said container and on which information relating to said toner is recorded, said information being read by a reading sensor when said toner cartridge is attached on said image forming system wherein said information recording part is cleaned by a cleaning unit when said toner cartridge is attached on said information forming system before the reading operation of said reading sensor.

16. A toner cartridge as set forth in claim 15, which further comprises:

a toner discharging hole formed in the tip portion of said container; and a spiral protruding portion, provided in the inner peripheral surface of said container, for carrying said toner toward said tip portion by rotation of said spiral protruding portion.

17. A toner cartridge as set forth in claim 16, wherein said information is recorded on said information recording part in any one of forms of optical pattern information capable of being optically recognized, shape information capable of recognized by contact, and magnetic information.

18. A toner cartridge as set forth in claim 17, wherein said information includes information indicating that said toner is a certified product.

19. A toner cartridge as set forth in claim 18, wherein said information includes information indicating that said toner is a certified product suitable for the specification of the destination for said image forming system.

* * * * *